US007866326B2

(12) United States Patent
Mills et al.

(10) Patent No.: US 7,866,326 B2
(45) Date of Patent: Jan. 11, 2011

(54) HAIR TREATMENT

(75) Inventors: Desmond Mills, Cheltenham (GB); Stephen Brown, Cheltenham (GB); Malcolm Mills, Cheltenham (GB)

(73) Assignee: The Dezac Group Limited, Cheltenham (GB)

( * ) Notice: Subject to any disclaimer, the term of this patent is extended or adjusted under 35 U.S.C. 154(b) by 571 days.

(21) Appl. No.: 11/665,828

(22) PCT Filed: Oct. 24, 2005

(86) PCT No.: PCT/GB2005/004114

§ 371 (c)(1),
(2), (4) Date: Apr. 20, 2007

(87) PCT Pub. No.: WO2006/043107

PCT Pub. Date: Apr. 27, 2006

(65) Prior Publication Data

US 2008/0000492 A1 Jan. 3, 2008

(30) Foreign Application Priority Data

Oct. 22, 2004 (GB) ..... 0423563.6

(51) Int. Cl.
*A45D 24/22* (2006.01)

(52) U.S. Cl. ..... 132/112

(58) Field of Classification Search ..... 132/112–116, 132/212, 270
See application file for complete search history.

(56) References Cited

U.S. PATENT DOCUMENTS

| | | | | |
|---|---|---|---|---|
| 2,463,611 | A * | 3/1949 | Green et al. | 132/108 |
| 3,030,968 | A | 4/1962 | Oberstar et al. | |
| 3,608,565 | A * | 9/1971 | Ensign | 132/212 |
| 4,671,302 | A * | 6/1987 | Hill | 132/212 |
| 4,830,030 | A * | 5/1989 | Busch et al. | 132/212 |
| 4,966,175 | A | 10/1990 | Kimura et al. | |
| 5,988,181 | A * | 11/1999 | Gable et al. | 132/210 |
| 6,250,312 | B1 * | 6/2001 | Dasilva | 132/208 |
| 6,848,452 | B2 * | 2/2005 | Kennedy et al. | 132/208 |
| 7,025,069 | B2 * | 4/2006 | Thiebaut | 132/270 |
| 2002/0038661 | A1 * | 4/2002 | Gueret | 132/320 |

FOREIGN PATENT DOCUMENTS

| | | |
|---|---|---|
| DE | 10261242 | 7/2004 |
| GB | 2398492 | 8/2004 |

* cited by examiner

*Primary Examiner*—Robyn Doan
(74) *Attorney, Agent, or Firm*—Young & Thompson

(57) ABSTRACT

A hair coloring apparatus comprises upper and lower hinged body parts closable about a lock of hair (58). Within the body parts is contained a drive mechanism and a color applicator (32) so that, when applied to a user's hair and closed, the apparatus moves progressively down a lock of hair (58) applying hair treatment material as it moves.

16 Claims, 9 Drawing Sheets

HAIR TREATMENT

This invention relates to hair treatment apparatus and methods and in particular, but not exclusively, to such apparatus and methods for applying colouring material to strands of hair. The invention extends however to the application of other material to hair. In this specification, the term 'colouring material' is used broadly to mean materials which alter the visual appearance of the hair whether this be by dyeing the hair, lightening the hair or applying colour, or sparkle, or other effects and the term 'colouring materials' is to be construed accordingly. The term "lock" is used to mean a selection of strands of hair.

It is well known to apply 'highlights' or 'lowlights' to hair by selectively applying a contrasting colour to a lock of hair to give the desired effect.

Highlighting, lowlighting and streaking of hair is generally done in a hairdressing salon by a skilled hairdresser using specialist materials. This is expensive and requires that the person requiring the highlights attend a hairdressers. When highlighting hair, the first step is to separate the lock of hair that is to be coloured from the remaining hair. This is normally performed by the stylist using a comb, or other suitable device, to separate the hair. Next, colouring the hair a particular colour is performed. This is normally performed by using a separate brush or other suitable colour applicator to apply a colouring agent to the selected lock of hair.

Separating and colouring of the hair requires a stylist to alternate between using the comb, then the brush. This can become cumbersome and inconvenient for the stylist as the stylist must repeatedly pick-up and set down the comb and brush.

Furthermore, the constant switching of the comb and brush necessarily lengthens the total time spent on the highlighting process. Moreover, the constant switching of the comb and brush makes highlighting one's own hair, without the use of a stylist, extremely difficult.

There are also home highlighting kits but these require similar techniques; and similar materials to those used in hairdressing salons. Such kits are not generally intended for short term colouring use and furthermore require a fair degree of skill or trial and error to achieve good results.

Accordingly, there is a need for apparatus and methods for applying a hair treatment material to a user's hair which embody or employ a device which is relatively easy to use by a relatively unskilled person without requiring assistance by others, and which generally contains the hair treatment material.

Accordingly, in one aspect, this invention provides apparatus for applying a hair treatment to a user's hair, said apparatus comprising a body portion defining in use a guide for a lock of hair passing through the apparatus, and an applicator region disposed adjacent said guide for contacting at least part of the lock of hair in use and applying thereto a hair treatment material. The above apparatus thereby provides an arrangement which facilitates separation of a lock of hair to be treated, and application of the treatment material, in a single device.

In this manner, the hair treatment material is applied to at least a selected region of the lock of hair as it passes through the guide, thus avoiding the need to manually paint or otherwise apply hair treatment material to the selected lock. In addition, the guide helps the user to select an appropriate lock of hair to be treated.

The apparatus also contains the treatment material thereby reducing the possibility of spillage, mess or damage during the treatment. Further, by combining hair selection and treatment in a single apparatus, it is easy to use and may be used effectively hands free or single-handed.

The apparatus preferably includes drive means for advancing the hair along the guide or modulating the advancement of hair along the guide. In this manner, movement of the hair relative to the applicator head may be driven or controlled as appropriate to provide a suitable relative speed for transfer of the hair treatment material.

The drive means may take various different forms according to the particular requirement. Thus the drive means may apply a motive force to the lock of hair to advance the hair relative to the body portion of the apparatus. In this way, when the drive means is appropriately energised, the apparatus may advance or 'crawl' along the length of a selected lock of hair to apply hair treatment material along a selected length.

In one arrangement, the drive means comprises a drive roller having a drive surface for contacting at least one side of the lock of hair in use, and being rotated in use by the drive means to cause advancement of the hair. In addition, or alternatively, the drive means may comprise a drive belt with a drive surface and being driveable to advance the hair through the apparatus in use. Still further, the drive means may comprise an oscillating friction pad which draws the hair through the apparatus. In these arrangements the drive roller or drive belt in use preferably drivingly contacts the hair with little or no slippage.

The power source for the drive may any suitable source such as a battery, a rechargeable battery, clockwork, mains power etc.

In another arrangement, the apparatus may be designed to be drawn manually through a user's hair, with the drive means being operable to apply a drag force to modulate the speed of advancement through the hair. Alternatively, the apparatus may be designed in use to be attached to the selected lock and then to be drawn through the user's hair by gravity, with the speed of movement through the hair being restricted by friction between the hair and a contacting portion of the apparatus.

Preferably the apparatus includes means for controlling the application of the treatment material.

The control means may comprise means for moving the hair in use into and out of contact with said applicator region. In a particular arrangement, a cam roller and friction pad arrangement may be provided cyclically to urge the hair in use into contact with the application head.

In another embodiment, there may be means for modulating the application of the treatment material to the hair in accordance with movement of the hair through the apparatus, thereby to apply said treatment material in a predetermined pattern or image.

In another arrangement, the apparatus may include two or more applicator regions for contacting the hair in use and for applying respective different materials to the hair. Preferably, the applicator is arranged directly adjacent the path taken by the hair in use such that it remains relatively stationary as the hair is drawn over it in use.

Preferably, the guide through which the hair passes is an internal guide within the apparatus. The guide conveniently substantially wholly encircles the strand of hair.

To allow introduction and withdrawal of the hair from the guide, the apparatus may include a guide element which may be introduced into the apparatus along the path to be followed by the hair and drawn back with a lock of hair attached to introduce the hair into the path to be followed by the hair. Alternatively or additionally the apparatus may be openable laterally. Thus the body portion may comprise two relatively moveable jaw portions, moveable between an open position in which a plurality of strands of hair may be introduced laterally into the guide, and a closed position, in which the hair is prevented from lateral removal thereof.

The cross-section of the guide may be generally round, to select a generally round bunch of hair; alternatively, it may be generally flat in cross-section to select a flattened tress of hair.

Whilst the invention has been described above, it extends to any inventive combination of the features set out above or in the following description.

The invention may be performed in various ways, and an embodiment thereof will now be described in detail, reference being made to the accompanying drawings, in which.

FIGS. 13(*a*) to (*h*) illustrate various colour applicator arrangements for use in the above embodiments.

Figure 16:
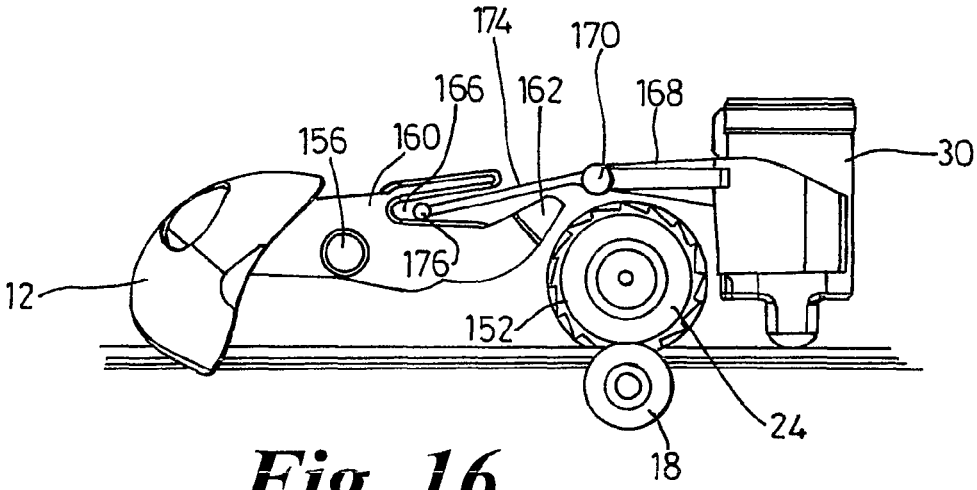
Figure 17:
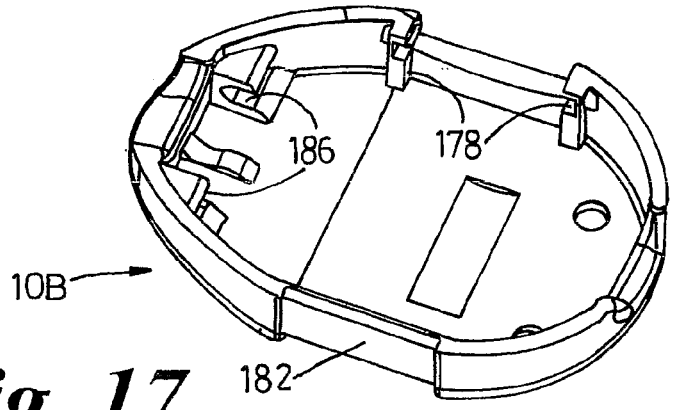
Figure 18:
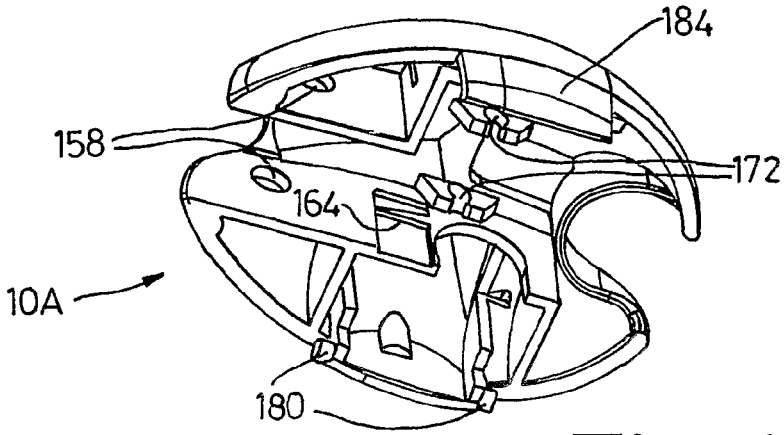
Figure 19:
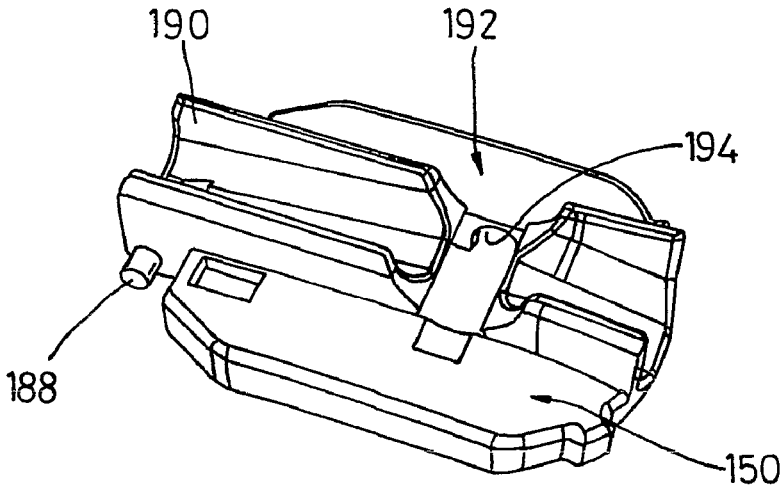
Figure 20:
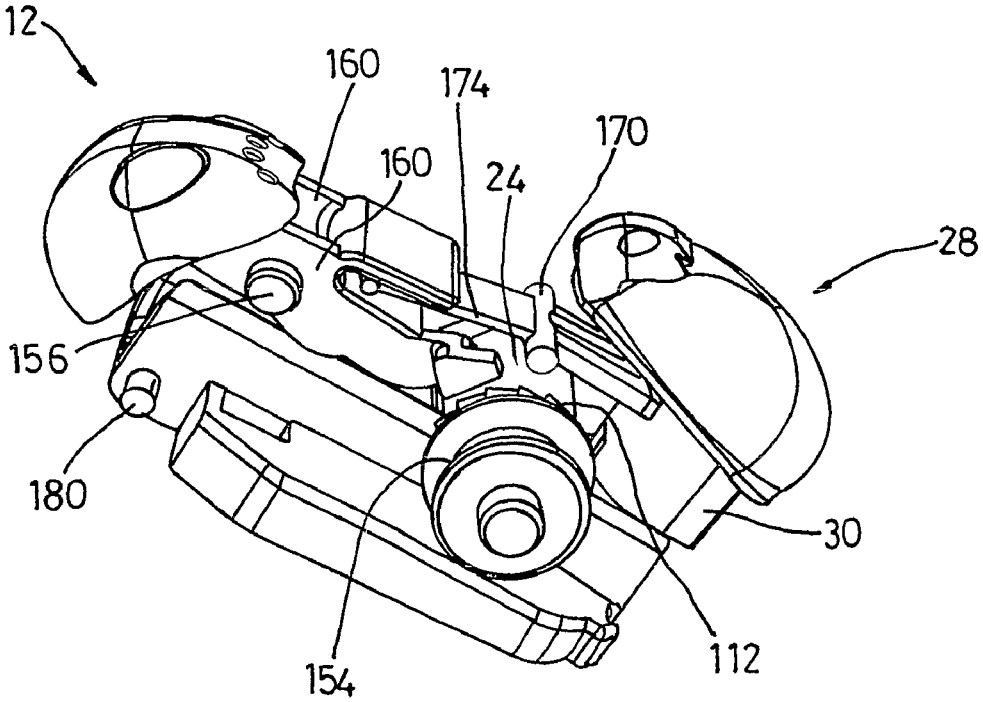

FIGS. 14(*a*) to (*d*) are views of another embodiment of hair treatment apparatus in accordance with this invention;

FIGS. 15(*a*) to (*d*) shows various configurations for attaching the hair treatment apparatus to the hair in use;

FIG. 16 is the side view showing selected components of a further embodiment of hair treatment apparatus in accordance with this invention;

FIG. 17 is a perspective view of the lower body portion of the embodiment of FIG. 16;

FIG. 18 is a perspective view of the upper body portion of the embodiment of FIG. 16;

FIG. 19 is a perspective view of the sprung roller plate of the embodiment of FIG. 16, and FIG. 20 is a perspective view of selected components of the assembly.

The various embodiments described herein are designed to be applied by a user to a strand of hair to allow streaks of colour to be applied to natural hair automatically, that is without requiring the user to paint or otherwise apply the colouring material. In a typical operation, the apparatus is attached to the hair near the root and, once activated, will move down the length of the hair until the end where it will run off ready for the next application.

Figure 1:
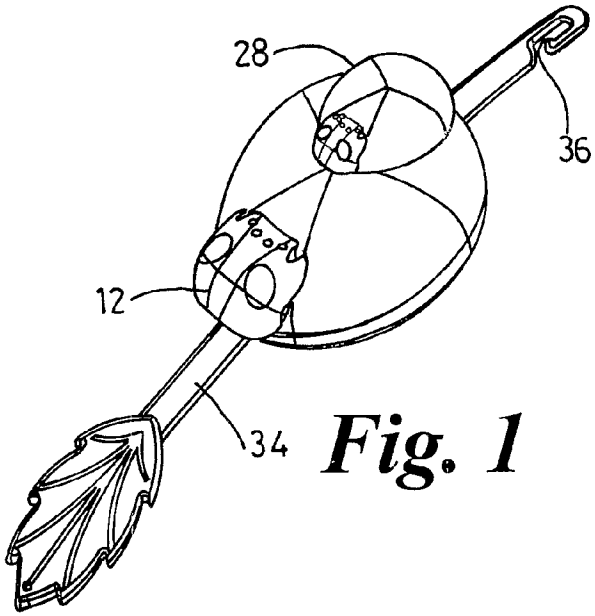
FIG. 1 is a general perspective of a first embodiment of hair colouring apparatus of this invention.
Figure 3:
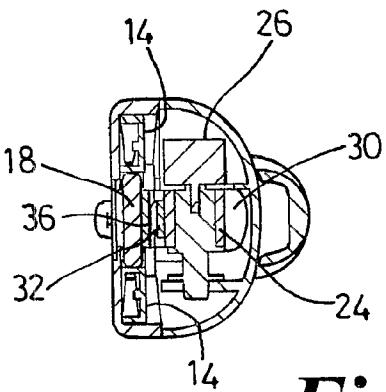
FIG. 3 is a transverse cross-section view taken on lines III-III of FIG. 2.

Referring initially to FIG. 1, in this embodiment a main body portion 10 is shaped to look like a beetle or bug, has a forward, hingable access flap 12 made to look like the head of the bug. The body portion is a generally hollow housing and may typically be formed of injection moulded plastics. Internally of the body 10 is provided an internal hair guide wall 14 which has a central channel 16 in which is located a rotatable idler wheel 18. At its left hand as viewed in FIG. 4, the guide wall terminates just short of an outlet aperture 20 and at its other end it terminates just short of an inlet aperture 22. Drive roller 24 is mounted parallel and facing the idler roller 18, the drive roller 24 being driven by means of an electric motor 26 (FIG. 3). The drive motor 26 is powered by a power source (not shown) and a suitable switch (not shown). The drive roller 24 is urged towards engagement with the idler roller 18 by means of a suitable spring mechanism (not shown). Both the drive roller 24 and the idler roller 18 have suitable rubber or similar friction coatings. The drive mechanism 24/18 operates in use to draw hair from right to left as viewed in FIG. 4.

Just upstream from the drive roller 24 is a removable colouring module 28 which has an external appearance made to look like a baby bug. The colouring module comprises of reservoir 30 for the colouring material and a suitable applicator 32 of porous material such as felt projects downwardly to contact hair passing along the hair path defined by the guide wall 14. The colouring module 28 is designed to be removable so that it can be recharged and/or replaced by a module containing a different hair colouring material.

Figure 4:
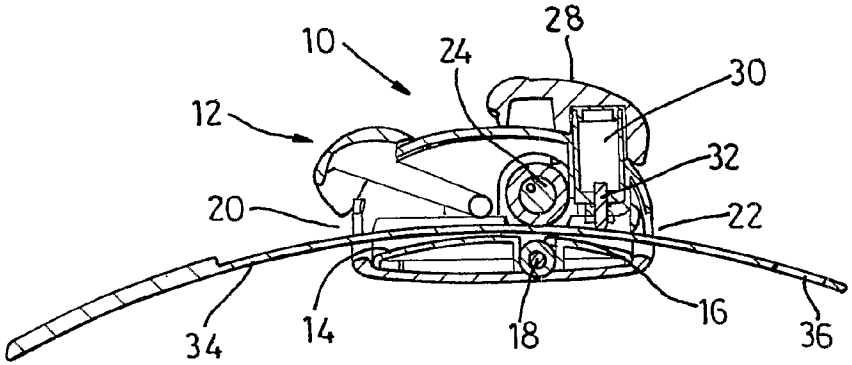
FIG. 4 is a longitudinal cross-section view taken on lines IV-IV of FIG. 2.
Figure 2:
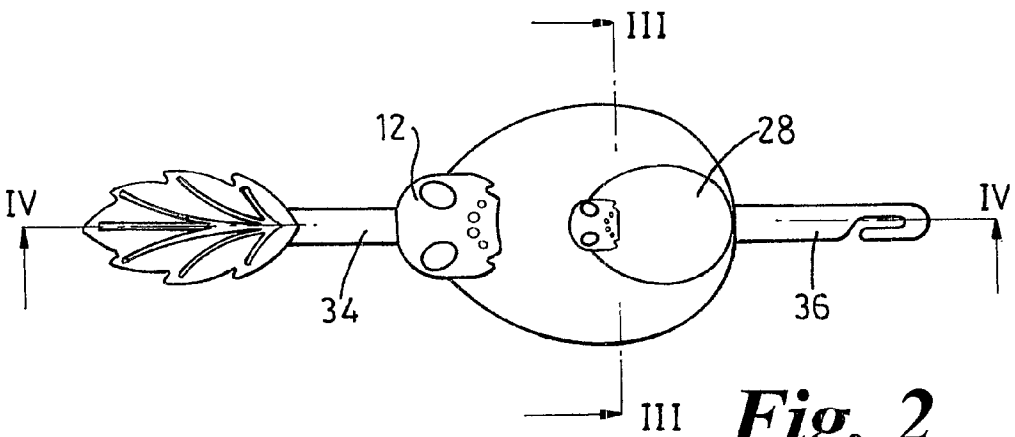
FIG. 2 is a top plan view of the embodiment of FIG. 1.

In this embodiment, hair to be coloured is introduced into the apparatus and passed along the hair path by means of an elongate guide strip 34 having a hooked region 36 at one end and dimensioned to pass through the device. In use the user threads the guide strip 34 through the apparatus to leave the hooked end clear, as seen in FIGS. 1, 2 and 4. The user then selects a lock of hair and hooks it into the hook 36. The hook 36 usefully serves to limit the amount of hair selected to ensure that the mechanism inside the apparatus does not jam. Having selected the lock of hair, the user then pulls the hair as afar as it can go through the apparatus so that the apparatus is adjacent the user's crown. The user then energises the electric motor 26 which hair into the apparatus where it is contacted by the applicator 32 to have colouring material applied and thereafter to passes between the drive roller 24 and the idler roller 18. This continues until the apparatus has crawled down the lock of hair to be released therefrom, whereupon the motor is stops. The user may then select another lock of hair and repeat the operation. On conclusion of the treatment process the flexible guide strip may be inserted into the apparatus for storage. In an alternative arrangement, the motor 26 may be a clockwork motor which may be wound up in a number of different ways, for example by a key or by being reverse driven. In a particularly preferred arrangement the motor may be wound up by pulling a string wound around a pulley associated with the motor. In this arrangement a clutch or operating lever may be provided which starts and stops the motor once wound up. This may be conveniently operated by hinging the access flap 12. Thus winding the motor may automatically cause the flap 12 to hinge to a raised position in which it inhibits operation of the motor. Pushing the flap 12 down then allows the motor to run.

Figure 5:
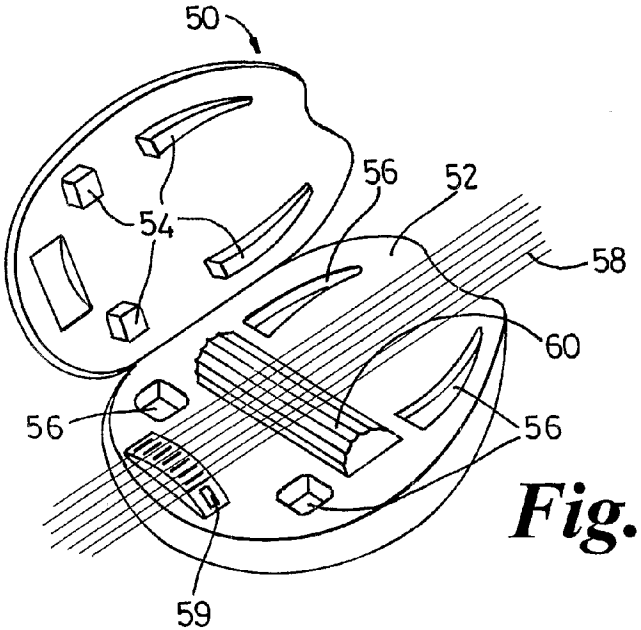
FIG. 5 is a schematic view of a first embodiment of hair colouring apparatus in accordance with this invention, with the apparatus shown open, with the drive being by means of a roller.

Referring now to FIG. 5, the apparatus in this embodiment comprises a two part hinged body comprising a base 50 and a hinged lid 52. The base and the lid may be moved between the open position shown in FIG. 5 and a closed position in which the lid 52 overlies the base 50. The lid 52 is provided with projecting guides 54 which cooperate with associated recesses 56 in the base and serve laterally to constrain a length of hair 58 sandwiched in use between the lid 52 and the base 50. In the base there is provided a porous inkpad 58 which communicates with an ink reservoir (not shown). Behind the inkpad, and sunken into the base is a drive roller 60. A suitable drive mechanism (not shown) such as an electric motor is contained in the base portion 50. In use, with the apparatus in the open position shown in FIG. 5, a user aligns a length of hair over the inkpad 58 and the drive roller 60 and between the guides 54 and then closes the device around the hair. The apparatus is applied near the root of the hair and the drive is operated so that the apparatus moves down the length of hair whilst supplying colouring material to the hair via the inkpad 58.

Figure 6:
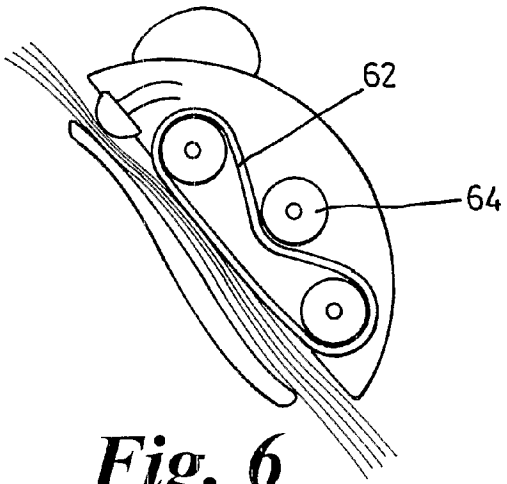
FIG. 6 is a schematic side view of another embodiment of the invention in which the drive is by means of a tractor belt.
Figure 7:
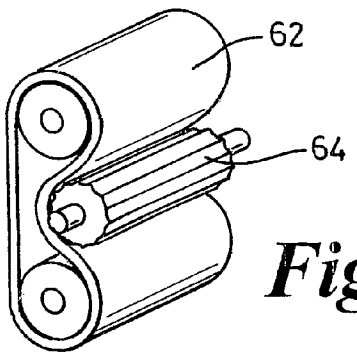
FIG. 7 is a detailed view of the tractor belt arrangement.

In FIG. 5 the motive force is applied to the hair by a drive roller 60. FIGS. 6 and 7 show an arrangement in which there is provided a drive belt 62 which runs around two spaced parallel idler rollers, the drive belt 62 being driven by a drive roller 64 through a suitable motor.

Figure 8:
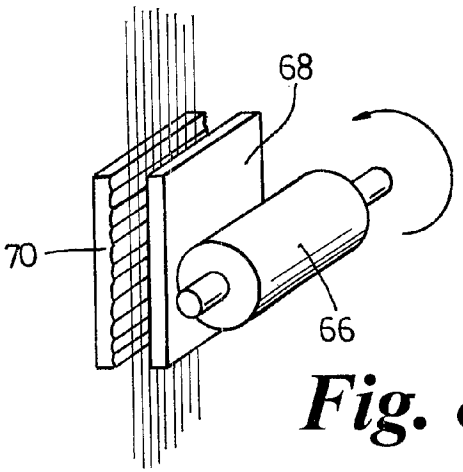
FIGS. 8 and 9 are perspective and side views of another drive arrangement using a cam roller in conjunction with a friction pad.
Figure 9:
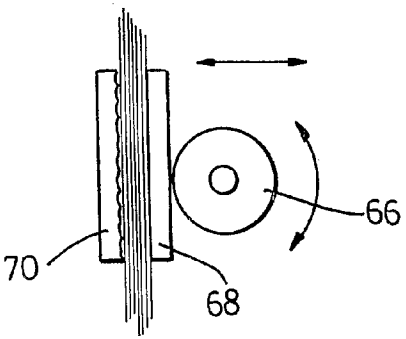

FIGS. 8 and 9 show an alternative drive arrangement where a cam roller 66 cooperates with a friction pad 68 cyclically to drive friction pad and the hair into contact with an inkpad 70.

Figure 10:
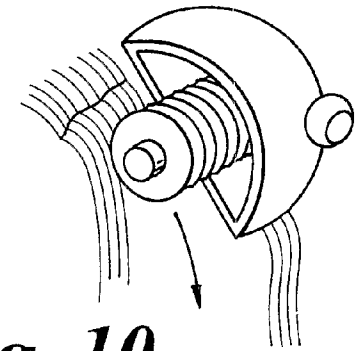
FIG. 10 is a schematic view of another embodiment wherein the apparatus is designed to be drawn through the hair of a user by gravity.

Referring to FIG. 10, in this embodiment the hair to be coloured is wrapped around a roller which is inserted into a housing which contains an ink applicator which contacts the hair wrapped around the roller in use. The housing, with roller and hair inserted, can then be drawn along the hair, either under the influence of gravity alone or by manual pulling by the user.

Figure 12:
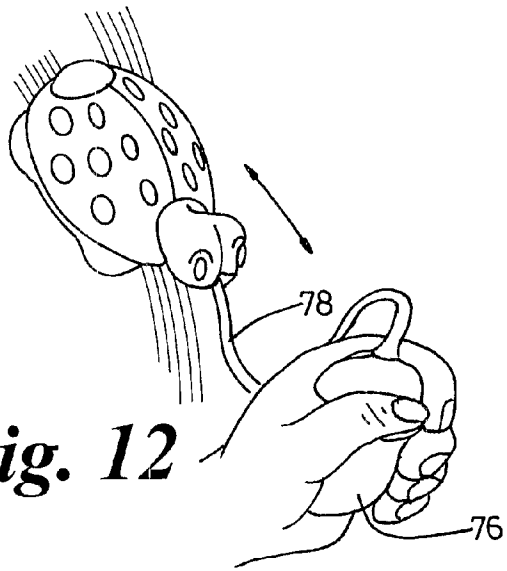
FIG. 12 is a schematic view of the arrangement of FIG. 11 in use.
Figure 11:
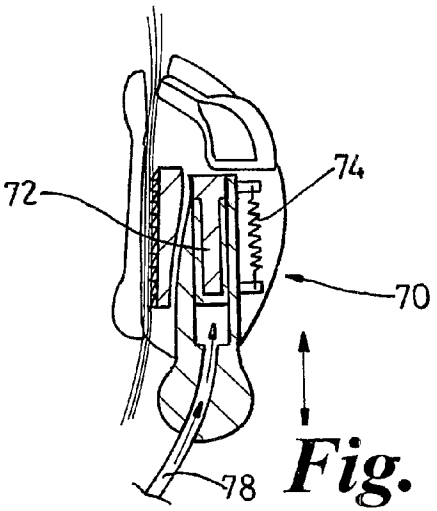
FIG. 11 is a schematic side view of another embodiment wherein the drive is by means of air, and incorporating a reciprocal friction pad arrangement.
Figure 13B:
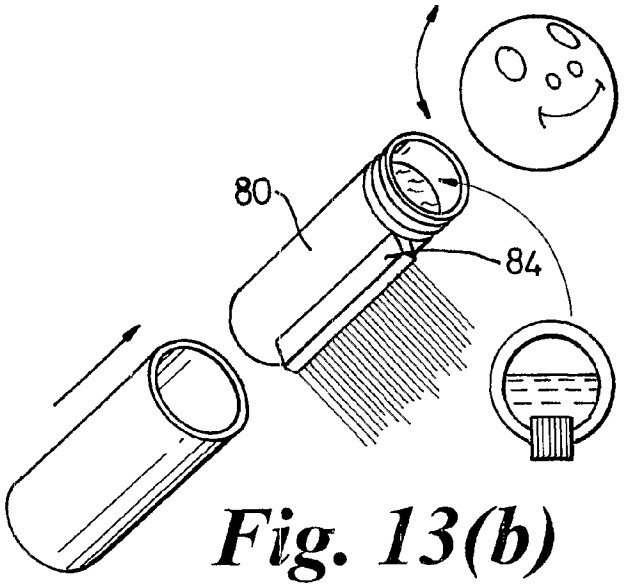
Figure 13D:
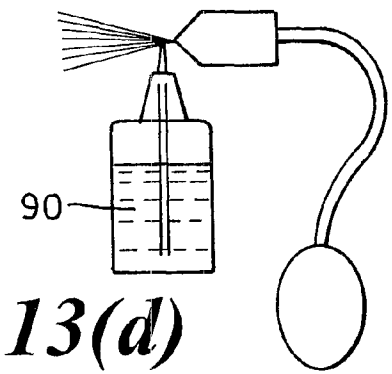
Figure 13A:
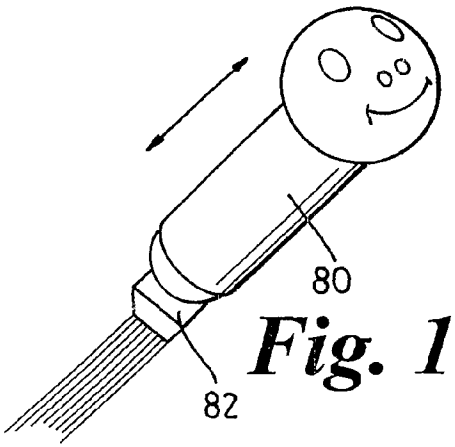
Figure 13C:
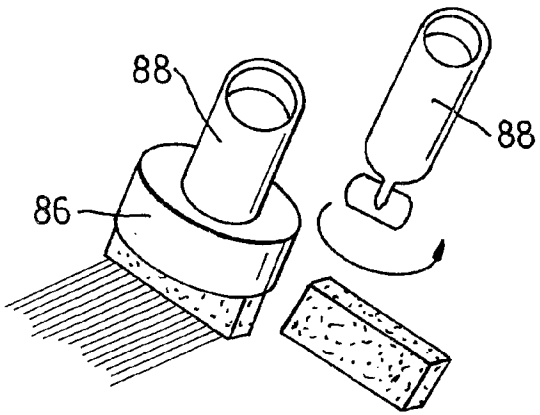
Figure 13E:
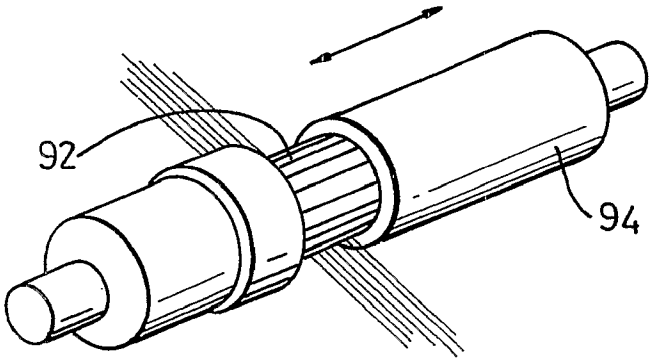
Figure 13F:
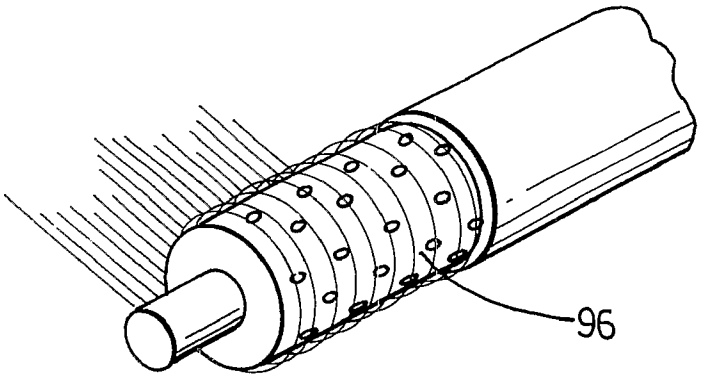
Figure 13G:
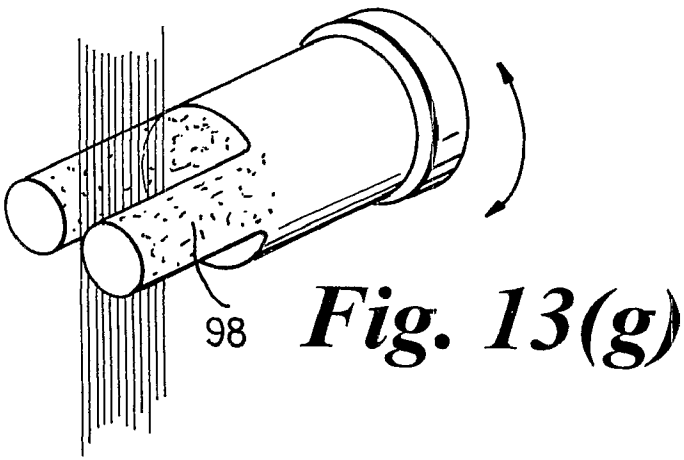
Figure 13H:
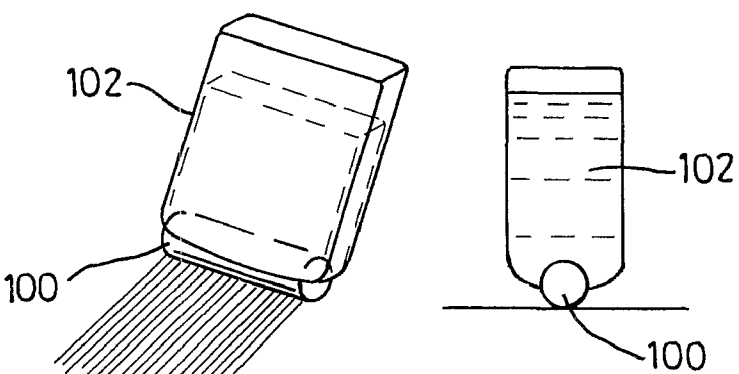
Figure 14A:
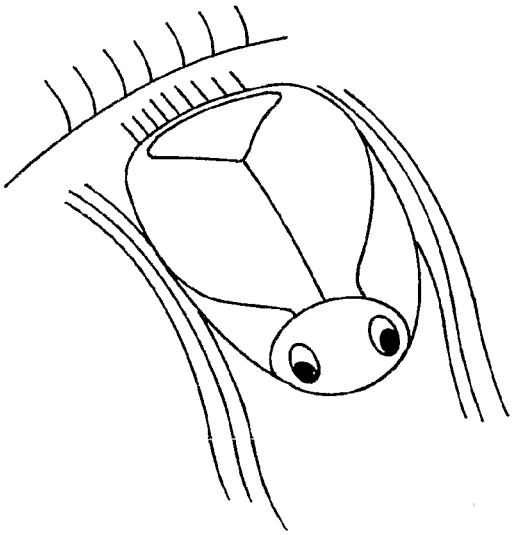
Figure 14B:
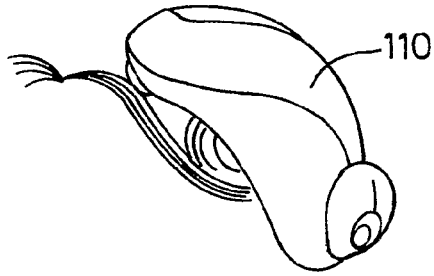
Figure 14C:
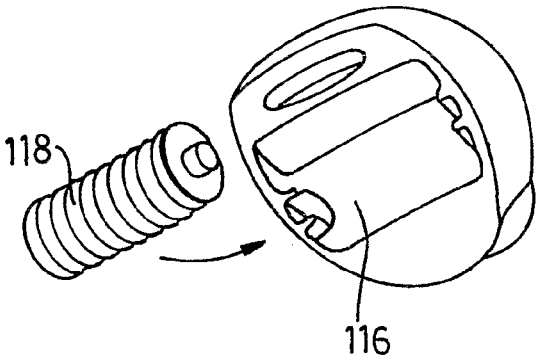
Figure 14D:
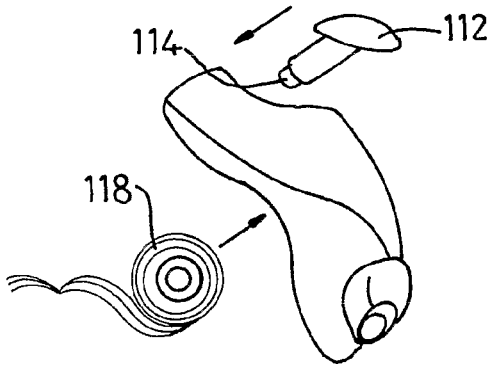
Figure 15A:
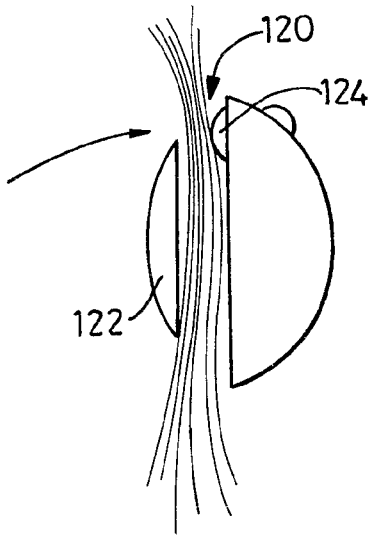
Figure 15B:
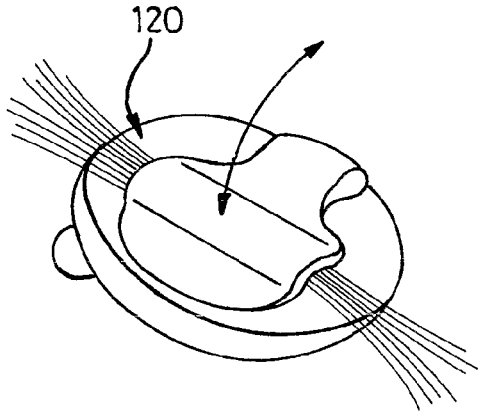
Figure 15C:
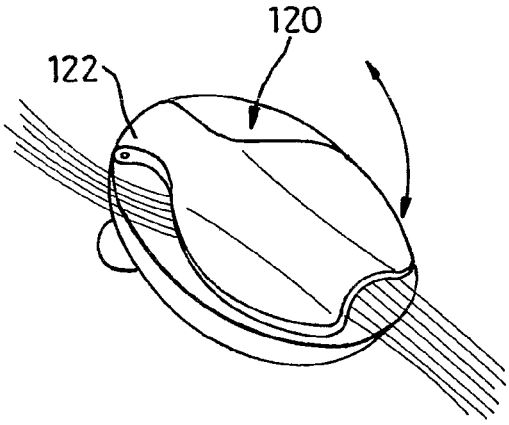
Figure 15D:
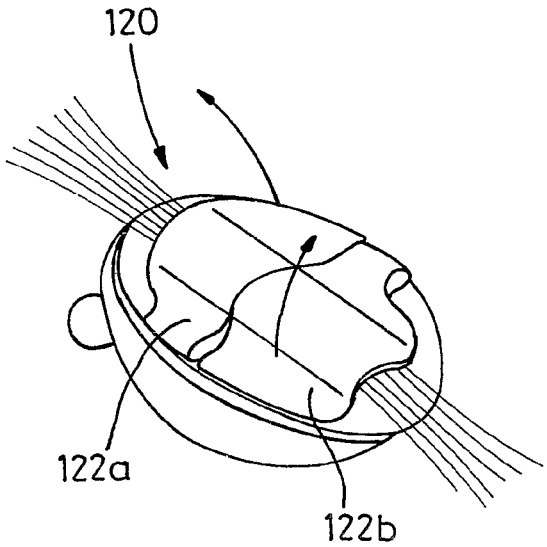

Referring now to FIGS. 11 and 12, an alternative arrangement is shown in which, a hair treatment apparatus of the general construction of FIG. 4 is attached to a strand of hair but here is provided with a pneumatic drive arrangement 70 comprising a piston/cylinder arrangement 72 which is biased by a spring 74 to a retracted position. The arrangement is driven by means of a hand-operated pump 76 which supplies a pulse of air into the piston/cylinder 72 via a tube 78. Continued operation of the hand pump causes reciprocation of the piston/cylinder arrangement which applies this linear reciprocating movement to a friction pad to cause the apparatus to advance the hair.

Referring now to FIGS. 13(*a*) to (*h*) there are shown various arrangements to be incorporated in the above embodiments to serve to apply the liquid colouring material to the hair. In FIG. 13(*a*) there is shown an arrangement wherein there is a reservoir 80 of liquid colouring material having at one end thereof a fibre tip applicator 82 for applying the liquid colouring material to the hair. FIG. 13(*b*) shows an arrangement in which a reservoir 80 of liquid colouring material has an extended lateral fibre portion 84 extending laterally to act as an applicator. In FIG. 13(*c*) there is shown an arrangement having an applicator in the form of a felt sponge 86 to which liquid colouring material is supplied from a disposable capsule 88. In FIG. 13(*d*) there is shown an atomising arrangement 90 for applying the colouring material to the hair by atomising it. It will be appreciated that different forms of atomiser may be used. In FIG. 13(*e*), there is shown a roller with a sponge or fibre applicator region 92 whose effective width can be varied by means of a cylindrical shutter 94. In FIG. 13(*f*) there is shown a roller arrangement 96 in which the hair is wrapped around the roller 96 in use, with the roller being supplied centrally with liquid colouring material. In FIG. 13(*g*) there is shown an arrangement with a bifurcated or twin fibre tip 98 designed to apply liquid colouring material to both sides of the strand of hair. Finally, FIG. 13(*h*) shows an arrangement in which a roller applicator 100 is used to apply liquid colouring material from a reservoir 102 onto the hair.

Referring now to FIG. 14, another gravity-driven colour treatment apparatus is shown operating on the same general principles as that shown in FIG. 10. In this arrangement a main body portion 110 houses a removable ink applicator 112 defining an applicator surface 114. On the underside of the body 110 is provided a recess 116 for receiving a hair roller 118. In use, the hair roller is removed from the recess and the user rolls a strand of hair to be coloured around the roller. The roller 118 with the hair wrapped around it is then located in the recess on the body and the device is drawn down the length of hair with the applicator surface 114 in contact with the hair as it unrolls from the roller 118.

Referring now to FIGS. 15(*a*) to (*d*), these show various arrangements for locating or retaining the hair adjacent the body of the hair colouring apparatus. As seen in FIG. 15(*a*) this embodiment of apparatus the hair passes through a channel 120 defined between the main body of the apparatus and a moveable retaining portion 122, such that as the hair passes through the device it contacts an applicator 124. In the arrangement of FIG. 15*b*, the retainer comprises a flap 122 hinged to one side of the device and defining therein a central tunnel through which the hair passes down the middle of the device. In some circumstances such a design may be less than ideal because it is 'handed'. In FIG. 15(*c*) a hinged retainer 122 is hinged centrally to the front of the device and defines respective left-and-right dogleg paths for the hair through the device. FIG. 15(*d*) shows an arrangement in which the hair passes centrally through the device and is retaining by split-hinge 122*a*, 122*b* retainers which are hinged one to either side of the body so that the arrangement is even-handed.

Referring now to the further embodiments shown in FIGS. 16 to 20 this is similar in design concept to the embodiments shown in FIGS. 1 to 4, and similar parts are given like reference numerals. In this embodiment the drive is by means of a cord driven clockwork mechanism (not shown) which drives a drive roller 24 which cooperates with an idler roller 18 which is rotatably mounted on a sprung roller plate 150 (FIG. 19) which urges the idler roller 18 towards the drive roller 24. As seen in FIGS. 16 and 20, the drive roller 24 carries a ratchet tooth wheel 152 at one end thereof next to a pulley region 154 on which the cord is stored for winding up the clockwork mechanism (not shown). The clockwork mechanism drives the drive pulley 24 in the clockwise sense as viewed in FIG. 16. A hingable flap 12 is pivotally attached to the top body portion 10A (See FIG. 18) by engagement of opposed lugs 156 in corresponding apertures 158 in the top portion. The access flap has two side elements 160 one of which extends back to carry a brake tooth 162 at its rear end and the other of which carries a detent projection (not shown) which cooperates with a complementary detent surface 164 on the top body portion 10A as seen in FIG. 18. The access flap also defines an extended jaw 166 which cooperates with a clip assembly 168 for holding the ink reservoir 30. Note that in FIG. 16 the baby bug cap visible in FIG. 20 has been removed for clarity. The clip 168 has opposed lugs 170 which click fit in associated recesses 172 in the top body portion 10A. Extending forward from adjacent the lugs 170 is a flexible tongue 174, the enlarged end 176 of which slides in the jaw 166 of the flap 12.

In the "ON" position shown in FIG. 16, the flap 12 is in its lowered "ON" position with the locking tooth 162 clear of the ratchet 152, so the drive roller 24 is free to rotate under the influence of the clockwork mechanism. Also, the clip assembly 168 is held such that the ink reservoir 30 is held in contact with the hair passing through the apparatus, with the flexible tongue providing a resilient bias. Lifting the access flap 12 brings the locking tooth 162 into engagement with the ratchet 152 thus preventing rotation of the drive roller 24 and tilting the clip assembly 168 counter clockwise to lift the ink reservoir 30 clear of the hair.

Referring now to the lower body portion this is provided at one side with hinged brackets 178 which receive hinge pins 180 on the top body portion and, on the other side of the lower body portion is a latchplate 182 which can be cooperatively engaged by a resiliently sprung latchplate 184 on the top body portion. At the forward end of the lower body portion are provided hinge brackets 186 which receive hinge pins 188 provided to either side of the roller plate 150. The roller plate 150 is urged upwardly by two springs (not shown) acting between the plate and the base surface of the lower portion 10B. The roller plate is provided with a U-shaped guide channel 190 through which the user's hair is drawn in use. The guide channel 190 is cut away as shown at 192 to receive the drive roller. The idler roller 18 is mounted on the roller plate 150 with its axle being received in the cut out portion 194.

In use, the walls of the U-shaped guide channel 190 align with the underneath portions of the side elements 160 of the flap 12 so that, when the device is in its OFF condition, closing it around a lock of hair to latch the latch 184 onto the latchplate 182, means that engagement of the walls of the U-shaped guide channel 190 with the underside of the arms 160 will tilt the hatch counter-clockwise thus moving it to its ON position, releasing the locking tooth 162 from the ratchet 152 and applying the reservoir to the hair in the guide.

The invention claimed is:

1. Apparatus for applying a hair treatment to a user's hair, said apparatus comprising a body portion defining in use a guide for a lock of hair passing through the apparatus, and an applicator region disposed adjacent said guide for contacting at least part of the lock of hair in use and applying thereto a hair treatment material, said apparatus including a drive for applying a motive force to the lock of hair to advance the hair relative to the body portion of the apparatus, and further including an operating member for being moved between an ON position in which said drive means is activated and an OFF position in which said drive means is inactive, wherein said operating member is also linked to move said applicator region between a hair-contacting position when said member is in its ON position and a position spaced away from the hair when said member is in its OFF position.

2. Apparatus according to claim 1, wherein the drive comprises a drive roller having a drive surface for contacting at least one side of the lock of hair in use, and being rotated in use by the drive to cause advancement of the hair.

3. Apparatus according to claim 1, wherein the drive is a clockwork drive.

4. Apparatus according to claim 1, wherein the drive includes a battery.

5. Apparatus according to claim 1, wherein the guide through which the hair passes is an internal guide within the apparatus.

6. Apparatus according to claim 5, wherein the guide is of generally U-shape.

7. Apparatus according to claim 5, wherein the guide is mounted for resilient movement relative to said body portion.

8. Apparatus according to claim 1 which further includes a separate guide element which is adapted to be introduced into the apparatus along the path to be followed by the hair and drawn back with a lock of hair attached to introduce the hair into the path to be followed by the hair.

9. Apparatus according to claim 1 wherein said body portion comprises two hingable elements openable laterally.

10. Apparatus according to claim 1, including an applicator device defining said applicator region.

11. Apparatus according to claim 10, wherein said applicator device is removable.

12. Apparatus according to claim 10, which further includes means for controlling the application of the treatment material.

13. Apparatus according to claim 1, including means for modulating the application of the treatment material to the hair in accordance with movement of the hair through the apparatus, thereby to apply said treatment material in a predetermined pattern or image.

14. Apparatus according to claim 1, which includes one or more further applicator regions for contacting the hair in use and for applying respective different materials to the hair.

15. Apparatus for applying a hair treatment to a user's hair, said apparatus comprising a body portion defining in use a guide for a lock of hair passing through the apparatus, and an applicator region disposed adjacent said guide for contacting at least part of the lock of hair in use and applying thereto a hair treatment material, said apparatus including a drive for advancing the hair along the guide or modulating the advancement of hair along the guide, wherein said drive is separate from said applicator region, and said applicator region is defined by an applicator device, the apparatus further including a controller for controlling the application of the treatment material, wherein the control means comprises means for moving the hair in use into and out of contact with said applicator region.

16. Apparatus according to claim 15, wherein said means for moving comprises a cam roller and friction pad arrangement cyclically to urge the hair in use into contact with the application head.

* * * * *